US008757242B2

(12) United States Patent
Hamasaki

(10) Patent No.: US 8,757,242 B2
(45) Date of Patent: Jun. 24, 2014

(54) DIE-CASTING DIE

(75) Inventor: Masafumi Hamasaki, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/697,443

(22) PCT Filed: Oct. 11, 2011

(86) PCT No.: PCT/JP2011/073309

§ 371 (c)(1),
(2), (4) Date: Nov. 12, 2012

(87) PCT Pub. No.: WO2012/050077

PCT Pub. Date: Apr. 19, 2012

(65) Prior Publication Data

US 2013/0056168 A1 Mar. 7, 2013

(30) Foreign Application Priority Data

Oct. 13, 2010 (JP) ..... 2010-230764

(51) Int. Cl.
*B22D 17/22* (2006.01)
*B22C 9/08* (2006.01)

(52) U.S. Cl.
CPC ..... *B22D 17/2272* (2013.01); *B22D 17/22* (2013.01); *B22C 9/082* (2013.01)
USPC ..... 164/303

(58) Field of Classification Search
CPC .... B22D 17/22; B22D 17/2272; B22D 17/30; B22D 17/2281; B22D 17/20; B22D 17/00; B22C 9/08; B22C 9/082
USPC ..... 164/284, 303, 133–135
See application file for complete search history.

(56) References Cited

U.S. PATENT DOCUMENTS

2007/0158884 A1* 7/2007 Tsukaguchi ..... 266/236

FOREIGN PATENT DOCUMENTS

CN 1905966 A 1/2007
CN 201253674 Y 6/2009

(Continued)

OTHER PUBLICATIONS

Machine Translation of JP09-267161 A.*

(Continued)

*Primary Examiner* — Kevin P Kerns
*Assistant Examiner* — Jacky Yuen
(74) *Attorney, Agent, or Firm* — Westerman, Hattori, Daniels & Adrian, LLP

(57) ABSTRACT

Provided is a die-casting die which is less likely to cause gas defects. A die-casting die in which a runner (1) is branched at a branch section (3), and cavities are connected to the respective downstream ends of the branched runner, wherein the runner (1) comprises a main runner (2) that is located upstream of the branch section (3) and a plurality of sub-runners (4) that are located downstream from the branch section (3), a volume section (5) having an opening (6) that opens toward the main runner (2) is formed at a portion of the branch section (3) that represents an extension of the direction of the main runner (2), and the width of the opening (6) is greater than the width of the main runner (2).

4 Claims, 4 Drawing Sheets

(56) References Cited

FOREIGN PATENT DOCUMENTS

| | | | | |
|---|---|---|---|---|
| JP | 06234041 | A | * | 8/1994 |
| JP | 7-68363 | A | | 3/1995 |
| JP | 9-267161 | A | | 10/1997 |
| JP | 11-090607 | A | | 4/1999 |
| JP | 2000-246417 | A | | 9/2000 |
| JP | 2005000953 | A | * | 1/2005 |
| JP | 2008-055487 | A | | 3/2008 |

OTHER PUBLICATIONS

International Search Report for PCT/JP2011/073309, mailing date of Dec. 27, 2011.
Written Opinion for PCT/JP2011/073309, mailing date of Dec. 27, 2011.
Chinese Office Action dated Mar. 20, 2014, issued in corresponding Chinese Patent Application No. 201180026654.6 with English translation (15 pages).

* cited by examiner

DIE-CASTING DIE

TECHNICAL FIELD

The present invention relates to a die-casting die.

BACKGROUND ART

Die-casting is a type of casting method in which, by forcing a melted nonferrous metal into a die under pressure, a high-precision casting having a superior casting surface can be mass-produced. The die comprises a cavity (product section) that corresponds with the shape of the product, and a passage (non-product section) through which the melted nonferrous metal flows to the cavity.

Patent Literature 1 (PTL 1) discloses a casting method that uses a die-casting die. In typical die-casting, the inside of the die is first evacuated down to reduced pressure using a vacuum apparatus or the like, and the molten metal (the melted nonferrous metal) is then poured into a plunger sleeve. The molten metal passes through the plunger sleeve and a runner, and fills the cavity. The filled molten metal is cooled and solidified, and the metal is then released from the die as the product.

For example, a compressor housing or the like, which represents one example of a pressure vessel, is produced by die-casting. FIG. 7 illustrates one example of a compressor housing. FIG. 7 illustrates a scroll-type compressor 100 for a car air-conditioning unit. The scroll-type compressor 100 has a housing 102 that constitutes the outer shell. The housing 102 is composed of a front housing 103 and a rear housing 104, which are fastened into a single integrated unit using bolts 105.

A sealing material 106 such as an O-ring is interposed at the bonding interface between the front housing 103 and the rear housing 104, thereby sealing the intake chamber formed inside the housing 102 in an airtight manner relative to the external atmosphere.

CITATION LIST

Patent Literature

{PTL 1} Japanese Unexamined Patent Application, Publication No. 2008-55487 (paragraphs [0002] and [0003])

SUMMARY OF INVENTION

Technical Problem

In die-casting, even when the inside of the die is evacuated down to reduced pressure prior to the injection of the molten metal, gas still remains within the non-product section. As a result, a problem arises in that the molten metal incorporates this residual gas during the process of flowing through the non-product section into the product section.

When the molten metal is cooled and solidified with this residual gas still incorporated therein, voids (gas defects) are generated within the product. If the product is a pressure vessel, then because the inside of the pressure vessel must be sealed in an airtight manner, if these voids occur at the sealing surface, they can cause pressure loss and coolant gas leakage and the like.

The present invention has been developed in light of the above issues, and has an object of providing a die-casting die which is less likely to cause gas defects.

Solution to Problem

In order to achieve the above object, the present invention provides a die-casting die in which a runner is branched at a branch section, and cavities are connected to the respective downstream ends of the branched runner, wherein the runner comprises a main runner that is located upstream of the branch section and a plurality of sub-runners that are located downstream from the branch section, a volume section having an opening that opens toward the main runner is formed at a portion of the branch section that represents an extension of the direction of the main runner, and the width of the opening is greater than the width of the main runner.

Conventionally, when a molten metal is poured into a die, the molten metal incorporates any residual gas remaining inside the runner before reaching the cavity. This residual gas is incorporated mostly within the leading portion of the poured molten metal. In the present invention, by providing the volume section at the branch section of the runner, the leading portion of the poured molten metal is collected in the volume section. The opening of the volume section opens toward the main runner, and the opening is designed with a greater width than the main runner. Consequently, the leading portion of the molten metal is collected inside the volume section before it can branch into the sub-runners. As a result, the portion of the molten metal containing a large amount of incorporated gas can be prevented from flowing into the cavities. In other words, a product having minimal gas defects can be produced.

In one aspect of the invention described above, the opening may have a sloped surface that widens toward the main runner.

By employing this configuration, the leading portion of the molten metal can be guided more readily into the volume section.

In another aspect of the invention described above, the volume section may comprise a molten metal inlet portion that includes the opening, and a well portion that is connected to the molten metal inlet portion on the opposite side from the opening, and the well portion is preferably spherical.

In die-casting, the molten metal is forced into the die under high pressure. By forming the well portion in a spherical shape, the stress concentration during introduction of the molten metal into the well portion can be reduced. This enables the lifespan of the die to be extended. In this description, the terms "sphere" and "spherical" include shapes that are substantially spherical and shapes that are at least partially spherical.

In the aspect described above, a notch that narrows toward the well portion is may be provided in the side surface of the molten metal inlet portion at the end of the molten metal inlet portion that connects to the well portion.

By employing this configuration, the molten metal and the residual gas collected in the well portion can be prevented from flowing back into the runner.

In the aspect described above, a pillar that extends in a different direction from the extension direction of the main runner may be provided inside the well portion.

Suspending a pillar inside the spherical well portion causes the molten metal introduced into the well portion to flow around the inner surface of the sphere. As a result, the molten metal can be more readily retained inside the well portion.

Further, in die-casting dies, it is generally considered that reducing the volume of the non-product section of the die is preferable in terms of improving the material yield. By providing a pillar in the well portion, the effective volume of the well portion can be reduced. In other words, the volume of the non-product section can be reduced.

In yet another aspect of the invention described above, the well portion is a circular channel, and the molten metal inlet portion is disposed along a tangential line of the well portion.

By forming the well portion as a circular shape, the stress concentration can be reduced. Because the molten metal inlet portion is disposed along a tangential line of the well portion, the molten metal is introduced along the inner periphery of the well portion, and flows like a vortex. This improves the retention of the molten metal within the well portion.

In the aspect described above, a spiral lap may be formed in the channel. This enables the molten metal to be retained even more reliably within the well portion.

In yet another aspect of the invention described above, a notch that dents inward into the sub-runner, causing the opening to expand toward the main runner, may be provided at the connection portion between the sub-runner and the opening.

By employing this configuration, the opening of the volume section is expanded, and the point of entry to the sub-runner is slightly narrowed, enabling the leading portion of the molten metal to be guided smoothly into the volume section.

Advantageous Effects of Invention

In the present invention, by providing the volume section that can retain molten metal at the branch section of the runner, a die can be obtained which is capable of producing products having minimal gas defects.

DESCRIPTION OF EMBODIMENTS

Embodiments of the die-casting die according to the present invention are described below with reference to the drawings.

Generally, a die-casting die is composed of a fixed die and an ejector die. Appropriate grooves are formed in the fixed die and the ejector die, so that when the two dies are brought together, a cavity that corresponds with the shape of the product is formed. A runner is connected to the cavity to enable a molten metal to be poured into the cavity.

Nonferrous metals such as aluminum or magnesium, or alloys of these metals, can be used as the molten metal material.

First Embodiment

In a die-casting die according to this embodiment, the runner has a branch section, and the main runner branches into two sub-runners at the branch section. A separate cavity is connected to the downstream end of each of the sub-runners.

Figure 1:
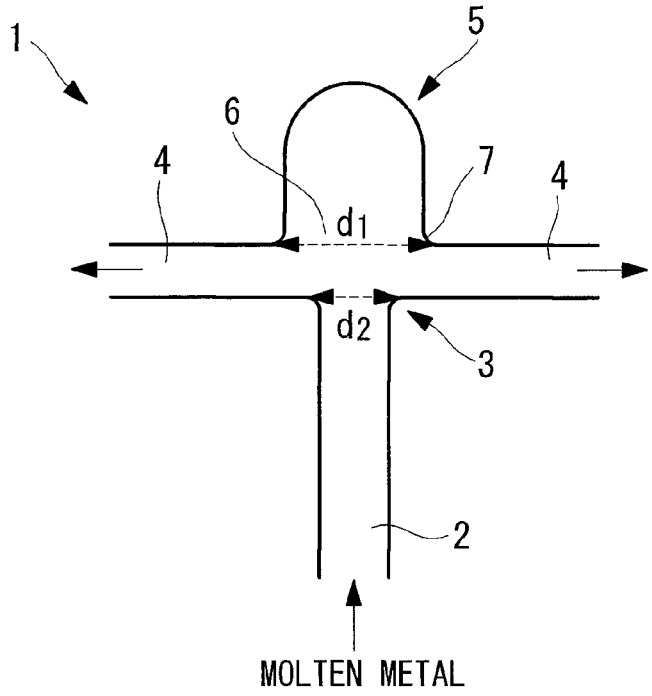
FIG. 1 is a plan view of a branch section of a runner of a die-casting die according to a first embodiment.

FIG. 1 illustrates a plan view of the branch section of a runner 1 of the die-casting die according to this embodiment. As illustrated in FIG. 1, the runner 1 is composed of a main runner 2 which branches into two sub-runners 4 at a branch section 3. The sub-runners 4 are positioned perpendicularly to the longitudinal axial direction of the main runner 2 and extend left and right in opposite directions, so that the molten metal flowing through the main runner 2 can be distributed stably into the two sub-runners 4 at the branch section 3.

A volume section 5 is provided at a portion of the branch section 3 that represents an extension of the direction of the main runner 2. The volume section 5 is formed with a volume that is capable of collecting the gas remaining in the main runner 2. The volume section 5 has an opening 6 that opens toward the main runner 2, and is connected to the runner 1. The width ($d_1$) of the opening 6 is preferably as narrow as possible, but is greater than the width ($d_2$) of the main runner 2. Here, the term "width" refers to the distance across the widest portion of the main runner 2 or the opening 6.

The opening 6 preferably has a sloped surface 7 that widens toward the main runner at the connection portion with the runner 1.

Further, a notch that dents inward into the sub-runner 4, causing the opening 6 to expand toward the main runner, may be provided in the sub-runner 4 at the connection portion with the opening 6. This notch is formed with a size that does not impede the flow of the molten metal from the main runner 2 to the sub-runner 4.

In this embodiment, the end of the volume section 5 opposite the opening 6 is formed with a substantially hemispherical shape.

Next is a description of the actions and effects obtained upon using a die-casting die of the structure described above. The molten metal poured into the die-casting die of the above structure flows through the main runner 2 while incorporating any residual gas remaining in the main runner 2, and the leading portion of the molten metal, which incorporates much of the residual gas, flows into the volume section 5 provided at the branch section 3. The opening 6 of the volume section 5 opens toward the main runner 2, and is formed with a greater width than the width of the main runner 2, and therefore the molten metal flows preferentially into the volume section 5, rather than branching into the sub-runners 4. The molten metal introduced into the volume section 5 is retained inside the volume section 5. When the volume section 5 becomes filled with the molten metal, the following molten metal branches and flows into the sub-runners 4 that extend left and right from the branch section 3, and then eventually enters the cavities connected to the downstream ends of the sub-runners.

If the opening 6 is sloped so as to widen toward the main runner 2, then the molten metal can be guided more readily into the volume section 5.

If a notch is provided in the sub-runners 4, then the molten metal that has entered the volume section 5 can be prevented from flowing into the sub-runners.

Example 1

Using a die-casting die of the above structure, a rear housing for a scroll-type compressor for use in a car air-conditioning unit was produced. The main runner 2 had a width of 25 mm. The sub-runners 4 had a width of 20 mm. The volume section 5 had a volume of approximately 2,000 $mm^3$ (and a radius of 25 mm), and the width of the opening 6 was 50 mm. An aluminum alloy that had been melted at a temperature of 660° C. was used as the molten metal.

Comparative Example 1

Figure 6:
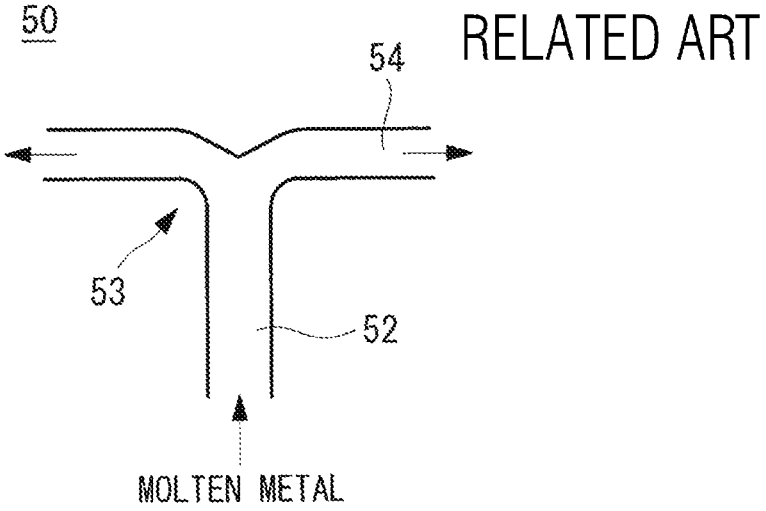
FIG. 6 is a plan view of a branch section of a runner of a conventional die-casting die.
Figure 7:
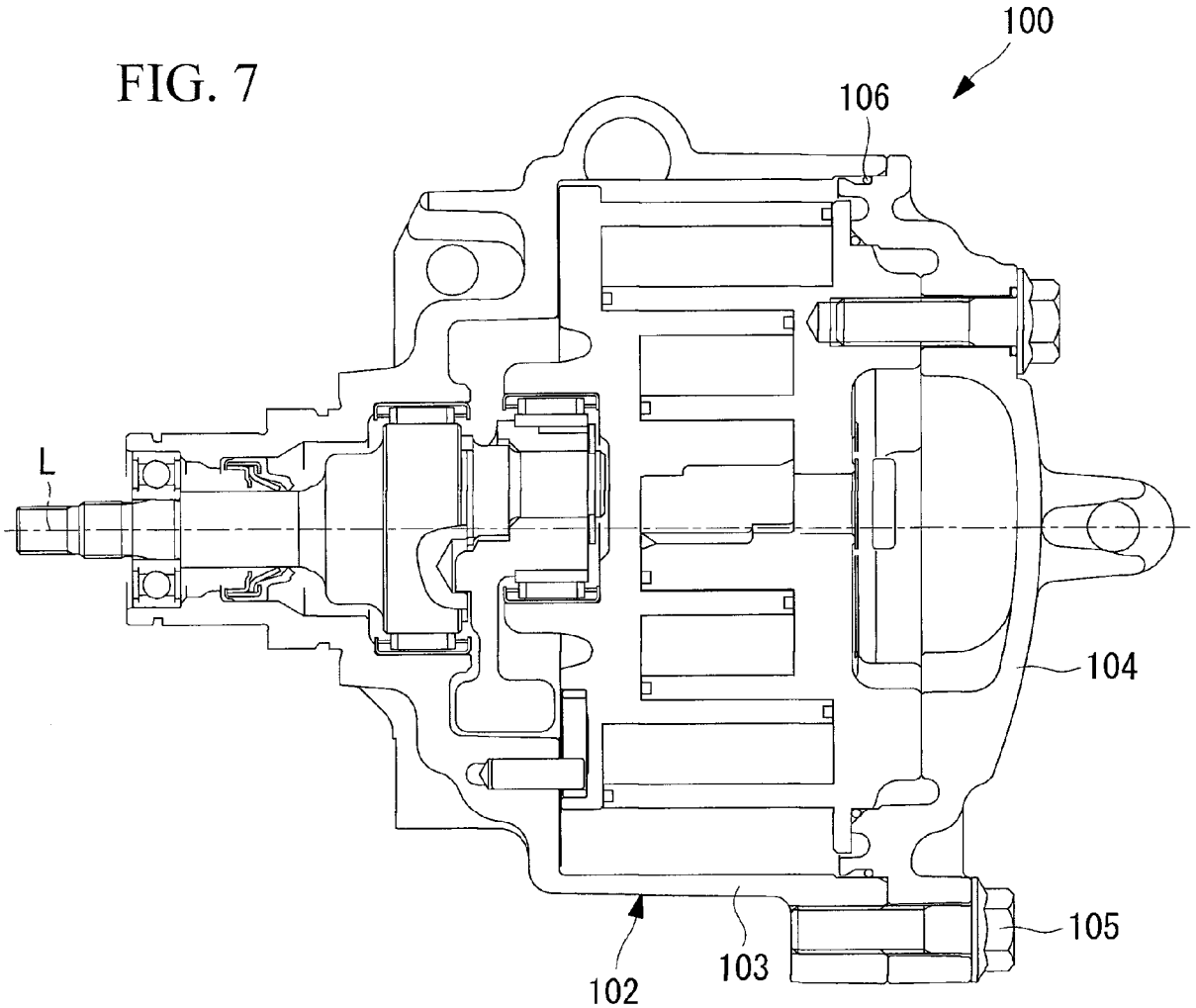
FIG. 7 is a diagram illustrating an example of a compressor housing.

Using a conventional die-casting die in which no volume section had been formed at the branch section, a rear housing was produced in the same manner as above. With the exception of not providing the volume section, the die-casting die was formed with the same structure as that described in the above embodiment. FIG. 6 illustrates a plan view of the branch section of a runner 50 of a conventional die-casting die. The runner 50 has a configuration in which a main runner 52 branches into two sub-runners 54 at a branch section 53 partway along the runner.

The amount of gas incorporated in the molten metal during the production processes of the example 1 and the comparative example 1 was measured to evaluate the level of gas defects. For the example 1, the value of an index that indicates the degree of oxidation of the molten metal was approximately half that observed for the comparative example 1. This result confirmed that by providing the volume section at the runner branch section, a product having fewer gas defects could be produced.

Second Embodiment

Figure 2:
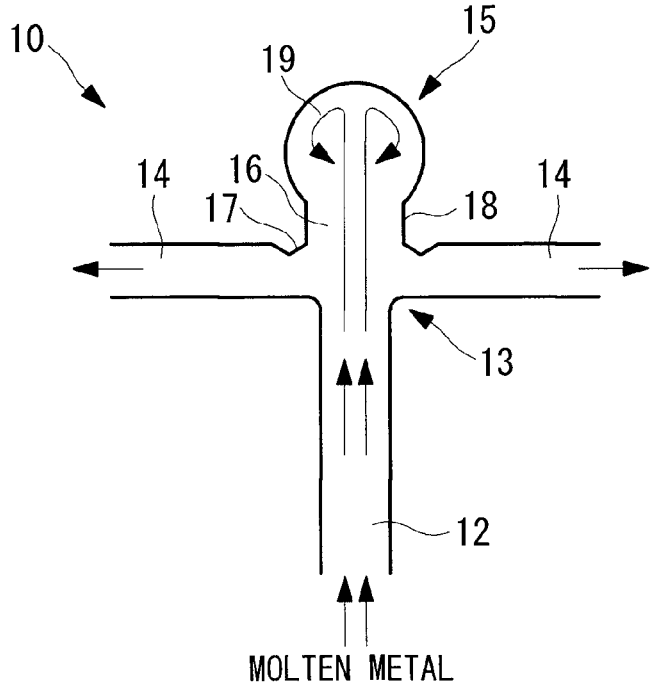
FIG. 2 is a plan view of a branch section of a runner of a die-casting die according to a second embodiment.

FIG. 2 illustrates a plan view of the branch section of a runner 10 of a die-casting die according to this embodiment. In this embodiment, with the exception of the volume section, the structure is the same as that of the first embodiment.

A volume section 15 is composed of a molten metal inlet portion 18 and a well portion 19.

The molten metal inlet portion 18 has an opening 16 that opens toward a main runner 12, and is connected to a runner 10. In the same manner as that described in the first embodiment, the width of the opening 16 is greater than the width of the main runner 12. A well portion 19 is connected to the molten metal inlet portion 18 on the opposite side from the opening 16. The molten metal inlet portion 18 is formed with the same width from the opening 16 toward the opposite end of the inlet portion. The length of the molten metal inlet portion 18 from the opening 16 to the opposite end of the inlet portion is set appropriately in accordance with factors such as the width of the main runner 12. The inner surface of the molten metal inlet portion 18 is a smooth shape with no unevenness.

A notch 17 that dents inward into the sub-runner 14, causing the opening 16 to expand toward the main runner 12, may be provided in the sub-runner 14 at the connection portion with the opening 16. This notch 17 is formed with a size that does not impede the flow of the molten metal from the main runner 12 to the sub-runner 14.

Further, the opening 16 may be sloped so that the connection portion with the runner widens toward the main runner.

The well portion 19 is formed with a spherical shape, and is formed with a volume that is capable of collecting the residual gas remaining in the main runner 12.

In die-casting, the molten metal is forced into the die at a pressure of approximately 1,000 atmospheres. In the die-casting die of the structure described above, because the well portion 19 is spherical, the stress concentration that occurs when the molten metal enters the volume section 15 can be reduced. As a result, the lifespan of the die-casting die can be extended. Further, by making the well portion 19 spherical, the molten metal that flows into the well portion collides with the end face of the volume section 15, changes flow direction, and flows around the inner surface of the well portion 19. As a result, the introduced molten metal can be more readily retained inside the well portion 19. The molten metal inlet portion 18 is formed with the same width from the opening 16 toward the opposite end of the inlet portion. The inner surface of the molten metal inlet portion 18 has a smooth shape. Accordingly, the molten metal can be guided more smoothly into the well portion 19. Further, if a notch is provided in each of the sub-runners 14, then the molten metal that has entered the volume section 15 can be prevented from flowing into the sub-runners 14. Furthermore, if the opening 16 is sloped so as to widen toward the main runner 12, then the molten metal can be guided more readily into the molten metal inlet portion 18. By using a die-casting die having this type of structure, a product having minimal gas defects can be produced.

Third Embodiment

Figure 3:
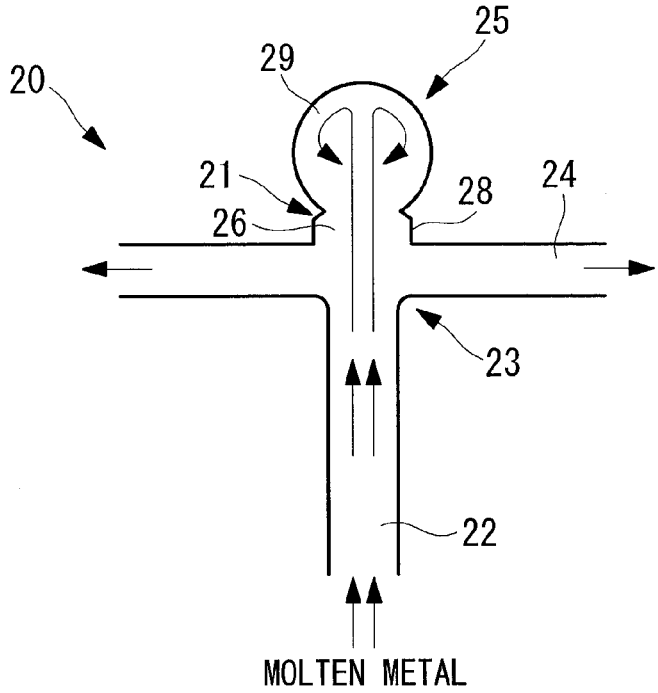
FIG. 3 is a plan view of a branch section of a runner of a die-casting die according to a third embodiment.

FIG. 3 illustrates a plan view of the branch section of a runner 20 of a die-casting die according to this embodiment. In this embodiment, with the exception of the molten metal inlet portion, the structure is the same as that of the second embodiment.

A volume section 25 is composed of a molten metal inlet portion 28, and a well portion 29 that is connected to the molten metal inlet portion 28.

A notch 21 is formed in the side surface of the molten metal inlet portion 28, at the end where the inlet portion connects to the well portion 29, so that the width of the molten metal inlet portion 28 narrows toward the well portion 29.

In the die-casting die of the above structure, by providing the notch 21 in the molten metal inlet portion 28 at the end that connects to the well portion 29, the molten metal introduced into the well portion 29 can be prevented from flowing back into the molten metal inlet portion 28. Consequently, the molten metal containing a large amount of incorporated gas can be more easily retained in the well portion 29. By using a die-casting die having this type of structure, a product having minimal gas defects can be produced.

Fourth Embodiment

Figure 4:
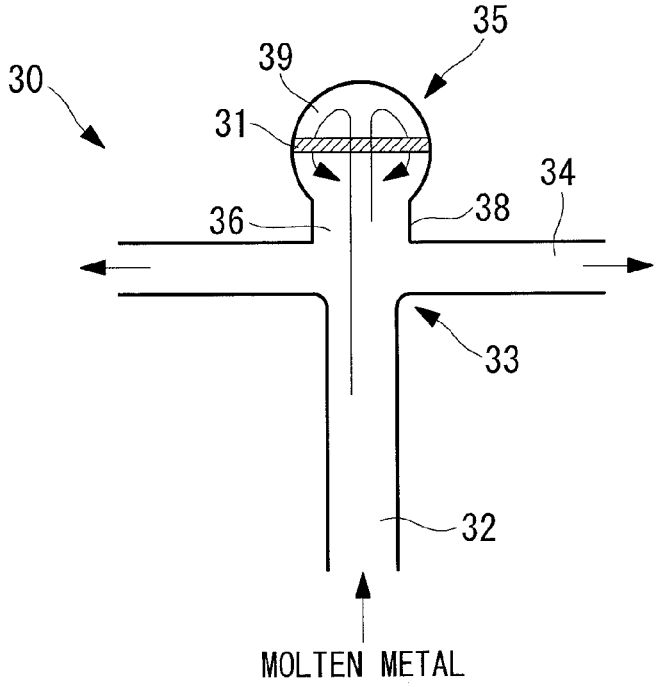
FIG. 4 is a plan view of a branch section of a runner of a die-casting die according to a fourth embodiment.

FIG. 4 illustrates a plan view of the branch section of a runner 30 of a die-casting die according to this embodiment. In this embodiment, with the exception of the provision of a pillar inside the well portion, the structure may be the same as that of the second embodiment or the third embodiment.

A well portion 39 is spherical, and a pillar 31 that extends in a different direction from the extension direction of a main runner 32 is provided inside the well portion 39. The pillar 31 is preferably disposed at a location across an internal diameter of the well portion. Further, the pillar 31 is preferably positioned perpendicularly to the longitudinal axial direction of a main runner 32. The pillar 31 preferably has a circular cylindrical shape, wherein the thickness of the pillar is set appropriately in accordance with the volume of the well portion 39.

In a die-casting die of the structure described above, by providing the pillar 31 inside the well portion 39, the flow direction of the molten metal that has entered the well portion 39 can be adjusted to a desired direction. This enables the molten metal containing a large amount of incorporated gas to be more easily retained in the well portion 39. By using a die-casting die having this type of structure, a product having minimal gas defects can be produced. Furthermore, by using a circular cylindrical pillar, the stress concentration can be reduced, enabling the lifespan of the die-casting die to be extended.

Fifth Embodiment

Figure 5:
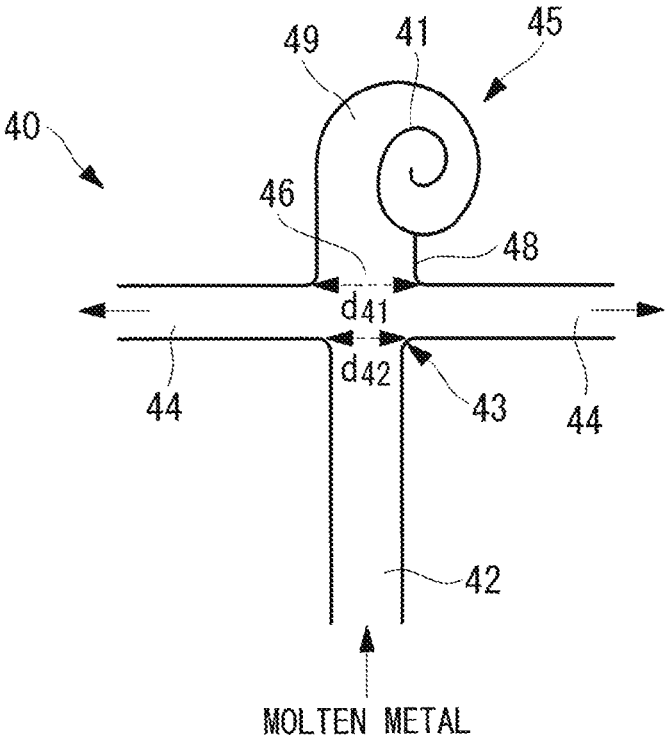
FIG. 5 is a plan view of a branch section of a runner of a die-casting die according to a fifth embodiment.

FIG. 5 illustrates a plan view of the branch section of a runner 40 of a die-casting die according to this embodiment. In this embodiment, with the exception of a difference in the shape of the volume section, the structure may be the same as that of the first embodiment or the third embodiment.

A volume section 45 is composed of a well portion 49 and a molten metal inlet portion 48.

The well portion 49 is a circular channel, and is formed with a volume that is capable of collecting the residual gas remaining in a main runner 42. The well portion 49 and the molten metal inlet portion 48 are arranged so that one side surface of the molten metal inlet portion 48 is disposed along a tangential line of the well portion 49. In other words, the volume section 45 has a structure in which the molten metal inlet portion 48 and the well portion 49 are connected together to form a P-shape.

A spiral lap 41 may be formed in the channel of the well portion 49. The lap 41 is disposed in a location that does not impede the entry of the molten metal into the well portion 49.

The molten metal inlet portion 48 has an opening 46 that opens toward the main runner 42 at the opposite end from where the well portion 49 is connected, and is connected to the runner 40 at this opening 46. In the same manner as that described for the first embodiment, the width ($d_{41}$) of the opening 46 is greater than the width ($d_{42}$) of the main runner 42. The molten metal inlet portion 48 is formed with the same width from the opening 46 toward the opposite end of the inlet portion. The length of the molten metal inlet portion 48 from the opening 46 to the opposite end of the inlet portion is set appropriately in accordance with factors such as the width of the main runner 42. The inner surface of the molten metal inlet portion 48 is a smooth shape with no unevenness. The opening 46 may be sloped so that the connection portion with the runner 40 widens toward the main runner 42.

In a die-casting die of the structure described above, the molten metal inlet portion 48 is disposed along a tangential line of the well portion 49. Consequently, the molten metal that enters the well portion 49 flows around the inner periphery of the well portion 49, and is more readily retained within the well portion. By using a die-casting die having this type of structure, a product having minimal gas defects can be produced.

In the first embodiment through to the fifth embodiment, the sub-runners were provided perpendicularly to the longitudinal axial direction of the main runner, but the positioning of the sub-runners is not limited to this particular configuration. For example, the sub-runners may branch so as to form a Y-shape.

REFERENCE SIGNS LIST

1, 10, 20, 30, 40, 50 Runner
2, 12, 22, 32, 42, 52 Main runner
3, 13, 23, 33, 43, 53 Branch section
4, 14, 24, 34, 44, 54 Sub-runner
5, 15, 25, 35, 45 Volume section
6, 16, 26, 36, 46 Opening
7 Sloped surface
17 Notch (sub-runner)
18, 28, 38, 48 Molten metal inlet portion
19, 29, 39, 49 Well portion
21 Notch (molten metal inlet portion)
31 Pillar
41 Lap

The invention claimed is:

1. A die-casting die, comprising:

a runner branched at a branch section, cavities being connectable to respective downstream ends of the runner, the runner comprising a main runner is located upstream of the branch section, a plurality of sub-runners located downstream from the branch section, and a volume section having an opening that opens toward the main runner, the volume section being formed at a portion of the branch section that represents an extension direction of the main runner, wherein a width of the opening of the volume section is greater than a width of the main runner, wherein the volume section comprises a molten metal inlet portion that includes the opening, and a well portion that is connected to the molten metal inlet portion on an opposite side from the opening, wherein the well portion is spherical, and wherein a width of the molten metal inlet portion is narrower than a diameter of the well portion.

2. The die-casting die according to claim 1, wherein a notch that narrows toward the well portion is provided in a side surface of the molten metal inlet portion at an end of the molten metal inlet portion that connects to the well portion.

3. The die-casting die according to claim 1, wherein a pillar that extends in a different direction from an extension direction of the main runner is provided inside the well portion, and wherein both ends of the pillar are fixed inside the well portion.

4. The die-casting die according to claim 1, wherein a notch that dents inward into the sub-runner, causing the opening to expand toward the main runner, is provided at a connection portion between the sub-runner and the opening, and wherein the notch only exists on a volume section side of the sub-runner.

* * * * *